US009353578B2

(12) United States Patent
Xia et al.

(10) Patent No.: US 9,353,578 B2
(45) Date of Patent: May 31, 2016

(54) HARDFACING COMPOSITIONS, METHODS OF APPLYING THE HARDFACING COMPOSITIONS, AND TOOLS USING SUCH HARDFACING COMPOSITIONS

(75) Inventors: Sike Xia, Pearland, TX (US); Zhou Yong, Spring, TX (US)

(73) Assignee: Smith International, Inc., Houston, TX (US)

( * ) Notice: Subject to any disclaimer, the term of this patent is extended or adjusted under 35 U.S.C. 154(b) by 731 days.

(21) Appl. No.: 12/728,932

(22) Filed: Mar. 22, 2010

(65) Prior Publication Data

US 2010/0236834 A1 Sep. 23, 2010

Related U.S. Application Data

(60) Provisional application No. 61/161,922, filed on Mar. 20, 2009.

(51) Int. Cl.

| | |
|---|---|
| ***E21B 10/46*** | (2006.01) |
| ***E21B 10/50*** | (2006.01) |
| ***C22C 29/00*** | (2006.01) |
| ***C22C 29/08*** | (2006.01) |
| *B22F 5/00* | (2006.01) |

(52) U.S. Cl.
CPC ..... *E21B 10/50* (2013.01); *C22C 29/005* (2013.01); *C22C 29/08* (2013.01); *B22F 2005/001* (2013.01)

(58) Field of Classification Search
CPC ..... C22C 29/005; C22C 29/08; F21B 10/50; B22F 2005/001
USPC ..... 75/240, 236; 51/307, 309
See application file for complete search history.

(56) References Cited

U.S. PATENT DOCUMENTS

| | | | | |
|---|---|---|---|---|
| 5,663,512 | A | 9/1997 | Schader et al. | |
| 5,715,899 | A | 2/1998 | Liang et al. | |
| 5,791,422 | A | 8/1998 | Liang et al. | |
| 5,921,330 | A | 7/1999 | Sue et al. | |
| 5,944,127 | A | 8/1999 | Liang et al. | |
| RE37,127 | E | 4/2001 | Schader et al. | |
| 6,248,149 | B1 | 6/2001 | Massey et al. | |
| 6,659,206 | B2 | 12/2003 | Liang et al. | |
| 6,782,958 | B2 | 8/2004 | Liang et al. | |
| 6,923,276 | B2 | 8/2005 | Overstreet et al. | |
| 7,217,180 | B2 | 5/2007 | John | |
| 7,303,030 | B2 | 12/2007 | Lockwood et al. | |
| 7,343,990 | B2 | 3/2008 | Pessier | |
| 7,597,159 | B2 | 10/2009 | Overstreet | |
| 2003/0000339 | A1 | 1/2003 | Findeisen et al. | |
| 2006/0005662 | A1 | 1/2006 | Lockwood et al. | |
| 2006/0060387 | A1 | 3/2006 | Overstreet et al. | |
| 2006/0207803 | A1 * | 9/2006 | Overstreet | 175/374 |
| 2006/0283638 | A1 | 12/2006 | Beuershausen et al. | |
| 2007/0056776 | A1 | 3/2007 | Overstreet et al. | |
| 2007/0056777 | A1 | 3/2007 | Overstreet | |
| 2007/0079905 | A1 | 4/2007 | Gerk | |
| 2007/0163812 | A1 | 7/2007 | Overstreet | |
| 2008/0053709 | A1 | 3/2008 | Lockstedt | |
| 2008/0073125 | A1 | 3/2008 | Eason et al. | |
| 2008/0083568 | A1 | 4/2008 | Overstreet | |
| 2008/0149397 | A1 | 6/2008 | Overstreet | |
| 2008/0202817 | A1 | 8/2008 | Massey et al. | |
| 2008/0223619 | A1 | 9/2008 | Overstreet | |
| 2008/0236333 | A1 * | 10/2008 | MacLeod | 75/255 |
| 2009/0113811 | A1 | 5/2009 | Overstreet | |
| 2010/0108399 | A1 * | 5/2010 | Eason et al. | 175/425 |

FOREIGN PATENT DOCUMENTS

| | | |
|---|---|---|
| GB | 2318803 | 7/1998 |
| GB | 2352727 | 2/2001 |
| WO | 2008042329 | 6/2008 |
| WO | 2008042330 | 6/2008 |
| WO | 2008079285 | 7/2008 |

OTHER PUBLICATIONS

International Search Report and Written Opinion dated Jun. 28, 2010 for corresponding PCT application No. PCT/ US2010/028154 filed Mar. 22, 2010.

* cited by examiner

*Primary Examiner* — Jessee Roe
*Assistant Examiner* — Christopher Kessler

(57) ABSTRACT

A hardfacing composition comprising an iron-based binder alloy; and a carbide phase comprising a sintered carbide and a cast tungsten carbide, wherein the cast carbide is present in a quantity of at least 22% by weight, based on the total weight of the carbide phase, and the cast carbide comprises particles having sizes in the range of from 30 to 60 mesh. Also provided is a hardfacing composition comprising an iron-based binder alloy; and a carbide phase comprising a super dense sintered carbide and one or more additional carbide materials, wherein the super dense sintered carbide is present in a quantity of at least 10 percent by weight (% w), based on the total weight of the carbide phase, and comprises particles having sizes in the range of from 16 to 40 mesh. Included are methods of manufacturing such hardfacing compositions and downhole tools having such improved hardfacing compositions applied thereon.

22 Claims, 4 Drawing Sheets

HARDFACING COMPOSITIONS, METHODS OF APPLYING THE HARDFACING COMPOSITIONS, AND TOOLS USING SUCH HARDFACING COMPOSITIONS

CROSS-REFERENCE TO RELATED APPLICATIONS

This application claim priority to U.S. Provisional Application No. 61/161,922, filed Mar. 20, 2009, which is hereby incorporated by reference in its entirety.

FIELD OF THE INVENTION

The invention relates generally to the field of hardfacing materials used to improve the wear resistance of tools, in particular downhole tools. More particularly, the invention relates to compositions of hardfacing materials which are particularly suitable for use on drill bits.

BACKGROUND OF THE INVENTION

Hardfacing materials are applied to a variety of downhole tools to improve wear resistance. Hardfacing may be used in an effort to improve both the hardness and fracture toughness of the downhole tool. Composite materials have been applied to the surfaces of downhole tools, in particular drill bits that are subjected to extreme wear. These composite or hard particle materials are often referred to as "hardfacing" materials and typically include at least one phase that exhibits relatively high hardness and another phase that exhibits relatively high fracture toughness. For example, a typical hardfacing material may include tungsten carbide particles substantially randomly dispersed throughout an iron-based matrix material. The tungsten carbide particles exhibit relatively high hardness, while the matrix material exhibits relatively high fracture toughness.

An example of downhole tools which may have hardfacing compositions applied thereon are bits for drilling oil wells. Drill bits used to drill wellbores through earthen formations generally are made within one of two broad categories of bit structures. Drill bits in the first category are generally known as "fixed cutter" or "drag" bits, which usually include a bit body formed from steel or another high strength material and a plurality of cutting elements disposed at selected positions about the bit body. The cutting elements may be formed from any one or combination of hard or ultra hard materials, including, for example, natural or synthetic diamond, boron nitride, and tungsten carbide.

Drill bits of the second category are typically referred to as "roller cone" bits, which include a bit body having one or more roller cones rotatably mounted to the bit body. The bit body is typically formed from steel or another high strength material and includes a plurality of cutting elements disposed at selected positions about the cones. The cutting elements may be formed from the same base material as the cone. These bits are typically referred to as "milled tooth" bits. Other roller cone bits include "insert" cutting elements that are press (interference) fit into holes formed and/or machined into the roller cones, referred to herein as "insert" roller cone bits. The inserts may be formed from, for example, tungsten carbide, natural or synthetic diamond, boron nitride, or any one or combination of hard or ultra hard materials.

Milled tooth bits include one or more roller cones rotatably mounted to a bit body. The one or more roller cones are typically made from steel and include a plurality of teeth formed integrally with the material from which the roller cones are made. Typically, a hardfacing material is applied to the exterior surface of the teeth to improve the wear resistance of the teeth. The hardfacing material typically includes one or more metal carbides, which are bonded to the steel teeth by a metal alloy ("binder alloy"). Once applied, the carbide particles are in effect suspended in a matrix of metal forming a layer on the surface. The carbide particles give the hardfacing material hardness and wear resistance, while the matrix metal provides fracture toughness to the hardfacing.

Many factors affect the durability of a hardfacing composition in a particular application. These factors include the chemical composition and physical structure (size and shape) of the carbides, the chemical composition and microstructure of the matrix metal or alloy, and the relative proportions of the carbide materials to one another and the matrix metal or alloy.

The metal carbide most commonly used in hardfacing is tungsten carbide. Many different types of tungsten carbides are known based on their different chemical compositions and physical structure. Three types of tungsten carbide commonly used in hardfacing drill bits are cast tungsten carbide, mono-tungsten carbide, and sintered tungsten carbide (also known as cemented tungsten carbide).

Tungsten generally forms two carbides, monotungsten carbide (WC) and ditungsten carbide ($W_2C$). Cast carbide is a eutectic mixture of the WC and $W_2C$ compounds, as such the carbon content in cast carbide is sub-stoichiometric, (i.e., it has less carbon than the monotungsten carbide). Cast carbide is typically made by resistance heating tungsten in contact with carbon in a graphite crucible having a hole through which the resultant eutectic mixture drips. The liquid is quenched in a bath of oil and is subsequently comminuted to the desired particle size and shape.

Monotungsten carbide is essentially stoichiometric tungsten carbide. One type of monotungsten carbide is macro-crystalline tungsten carbide. Macro-crystalline tungsten carbide may be formed using a high temperature thermite process during which ore concentrate is converted directly to monotungsten carbide.

Another type of monotungsten carbide is carburized tungsten carbide which is typically multicrystalline in form, i.e., composed of tungsten carbide agglomerates. Carburized tungsten carbide may be formed using a carburization process where solid-state diffusion of carbon into tungsten metal occurs to produce monotungsten carbide. Typical monotungsten carbide contains a minimum of 99.8% by weight of tungsten carbide with a total carbon content in the range of from about 6.08% to about 6.18% by weight, preferably about 6.13% by weight, based on the weight of tungsten carbide.

Sintered tungsten carbide comprises small particles of tungsten carbide (e.g., 1 to 15 microns) bonded together with a metal binder such as cobalt. Sintered tungsten carbide may be produced by mixing an organic wax, monotungsten carbide and metal binder; pressing the mixture to form a green compact; sintering the green compact at temperatures near the melting point of the metal binder; and comminuting the resulting sintered compact to form particles of the desired particle size and shape.

As mentioned above, conventional hardfacing of milled tooth bits usually comprises particles of tungsten carbide that are bonded to the steel teeth using a metal binder alloy. Most hardfacing on drilling bits uses steel or Ni based alloys as the metal binders, although other alloys may also be used.

A typical technique for applying hardfacing to a downhole tool such as a drilling bit is by oxyacetylene welding. A welding "rod" or stick may be formed of a tube of mild steel sheet enclosing a filler (carbide phase) which is primarily carbide particles. The carbide phase may also include deoxidizer for the steel, flux, and a resin binder to retain the particles in the tube during welding. The hardfacing is applied by melting the rod on the surface of the tool. The steel tube melts to weld to the surface and provides the matrix for the carbide particles in the hardfacing. During application, the deoxidizer alloys with the mild steel of the tube.

Although a mild steel sheet may be used when forming the tubes, the steel in the hardfacing as applied to a tool is a hard, wear resistant, alloy steel. This occurs through the mixing of other elements with the mild steel during welding.

It is particularly important to provide as much wear resistance and toughness as possible on the teeth of a rock bit cutter cone. Wear resistance is meant to include abrasion resistance, and/or erosion resistance. The effective life of the cone is enhanced as wear and fracture resistance of the hardfacing is increased. It is desirable to keep the teeth protruding as far as possible from the body of the cone since the rate of penetration of the bit into the rock formation is enhanced by maintaining longer teeth. As wear occurs on the teeth, they get shorter and the drill bit may be replaced when the rate of penetration decreases to an unacceptable level. It is desirable to minimize wear so that the footage drilled by each bit is maximized. This not only decreases direct cost, but also decreases the frequency of having to "round trip" a drill string to replace a worn bit with a new one.

One wear mechanism of the hardfacing material during drilling is abrasion wear. This is typically the dominant wear mechanism on the outer row of teeth on the cutter cone, also referred to as the heel or gage row (other rows of teeth are referred to as "inner rows"). This wear occurs as the teeth rub against the wall or "gage" of the borehole being drilled. Similar abrasion wear occurs on the flank and inner side surfaces of the teeth where drill cuttings run between the teeth.

A hardfacing material having a low toughness can experience flaking or chipping of the hardfacing material. Flaking or chipping of the hardfacing material on the crest of the teeth of the inner and gage rows can lead to cratering of the hardfacing material which can dramatically reduce the life of the bit. Chipping and flaking of the hardfacing result from fracture in the matrix and the carbide particles. Local chipping of the matrix surrounding the carbide particles may result in the dislodging, or pull-out, of the carbide particles which is responsible for cratering in the hardfacing material. Cratering results in a substantial loss of the hardfacing material during drilling which can lead to exposure of the relatively soft base metal of the teeth and subsequent rapid wear. As a result, the drilling efficiency is greatly reduced. Therefore, in addition to improving the wear resistance or hardness of the hardfacing material, it is also important to improve the toughness of the matrix and the carbide particles, especially at the crest of the teeth.

Thus, advances in wear resistance and toughness of hardfacing are desirable to enhance the durability of downhole tools, for example the footage a drill bit can drill before becoming dull and to enhance the rate of penetration of such drill bits. Such improvements translate directly into a reduction of drilling expenses. The composition of a hardfacing material and microstructure of the hardfacing material applied to the surfaces of a downhole tool, in particular a drill bit, are related to the degree of wear resistance and toughness. It is desirable to have a composition of hardfacing material that, when applied to wear surfaces, provides improved wear resistance and toughness.

SUMMARY OF THE INVENTION

In one aspect, one or more embodiments of the present invention relate to a hardfacing composition comprising an iron-based binder alloy; and a carbide phase comprising a sintered carbide and a cast tungsten carbide, wherein the cast carbide is present in a quantity of at least 22% by weight, based on the total weight of the carbide phase, and the cast carbide comprises particles having sizes in the range of from 30 to 60 mesh.

In another aspect, one or more embodiments disclosed herein relate to a drill bit comprising a bit body and a cutting structure, wherein at least a portion of an exterior surface of the drill bit has a layer of hardfacing disposed thereon, wherein the layer of hardfacing is formed using a hardfacing composition comprising an iron-based binder alloy; and a carbide phase comprising a sintered carbide and a cast tungsten carbide, wherein the cast carbide is present in a quantity of at least 22% by weight, based on the total weight of the carbide phase, and the cast carbide comprises particles having sizes in the range of from 30 to 60 mesh.

In yet another aspect, one or more embodiments disclosed herein relate to a method for applying a hardfacing composition to a surface of a drill bit, the method comprising: providing a drill bit having a bit body and a cutting structure; providing a hardfacing composition comprising an iron-based binder alloy; and a carbide phase comprising a sintered carbide and a cast tungsten carbide, wherein the cast carbide is present in a quantity of at least 22% by weight, based on the total weight of the carbide phase, and the cast carbide comprises particles having sizes in the range of from 30 to 60 mesh; applying the hardfacing composition to at least a portion of an exterior surface of the drill bit by heating the hardfacing composition such that the iron-based binder alloy melts; and solidifying the molten binder alloy.

In yet another aspect, one or more embodiments of the present invention relate to a hardfacing composition comprising an iron-based binder alloy; and a carbide phase comprising a super dense sintered carbide and one or more additional carbide materials, wherein the super dense sintered carbide is present in a quantity of at least 10 percent by weight (% w), based on the total weight of the carbide phase, and comprises particles having sizes in the range of from 16 to 40 mesh.

In yet another aspect, one or more embodiments disclosed herein relate to drill bit comprising a bit body and a cutting structure, wherein at least a portion of an exterior surface of the drill bit has a layer of hardfacing disposed thereon, wherein the layer of hardfacing is formed using a hardfacing composition comprising an iron-based binder alloy; and a carbide phase comprising a super dense sintered carbide and one or more additional carbide materials, wherein the super dense sintered carbide is present in a quantity of at least 10 percent by weight (% w), based on the total weight of the carbide phase, and comprises particles having sizes in the range of from 16 to 40 mesh.

In yet another aspect, one or more embodiments disclosed herein relate to a method for applying a hardfacing composition to a surface of a drill bit, the method comprising: providing a drill bit having a bit body and a cutting structure; providing a hardfacing composition comprising an iron-based binder alloy; and a carbide phase comprising a super dense sintered carbide and one or more additional carbide materials, wherein the super dense sintered carbide is present in a quantity of at least 10 percent by weight (% w), based on the total weight of the carbide phase, and comprises particles having sizes in the range of from 16 to 40 mesh; applying the hardfacing composition to at least a portion of an exterior surface of the drill bit by heating the hardfacing composition such that the iron-based binder alloy melts; and solidifying the molten binder alloy.

Other aspects and advantages of the invention will be apparent from the following description and the appended claims.

DETAILED DESCRIPTION OF THE INVENTION

Figure 1:
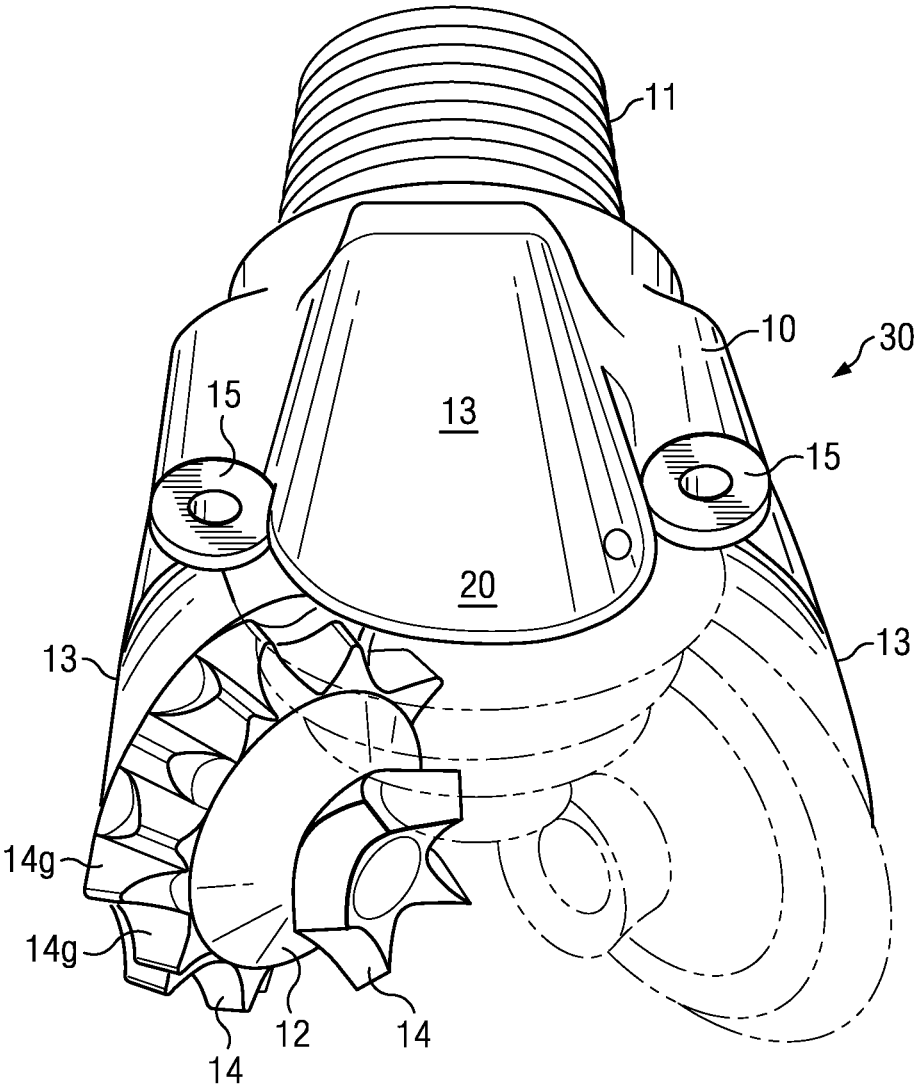
FIG. 1 illustrates a milled tooth roller cone drill bit.

In one aspect, embodiments disclosed herein relate to improved hardfacing compositions for a downhole tool such as a drill bit. In particular, one or more embodiments disclosed herein relate to hardfacing compositions, methods of manufacturing such hardfacing compositions and downhole tools having such improved hardfacing compositions applied thereon. Such hardfacing compositions exhibit improved properties such as wear resistance and toughness.

Certain terms are used throughout the following description and claims refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in somewhat schematic form and some details of conventional elements may not be shown in the interest of clarity and conciseness.

In the following description and in the claims, the terms "including" and "comprising" are used in an open-ended fashion, and thus, should be interpreted to mean "including, but not limited to . . . . "

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also include individual numerals such as 2, 3, 4, and sub-ranges such as 1 to 3, 2 to 4, etc. The same principle applies to ranges reciting only one numerical value, such as "at most 4.5", which should be interpreted to include all of the above-recited values and ranges. Further, such an interpretation should apply regardless of the breadth of the range or the characteristic being described.

As used herein, the mesh sizes refer to standard U.S. ASTM mesh sizes. The mesh size indicates a wire mesh screen with that number of holes per linear inch, for example a "16 mesh" indicates a wire mesh screen with sixteen holes per linear inch, where the holes are defined by the crisscrossing strands of wire in the mesh. The hole size is determined by the number of meshes per inch and the wire size. When using ranges to describe sizes of particles, the lower mesh size denotes (which may also have a "−" sign in front of the mesh size) the size of particles that are capable of passing through an ASTM standard testing sieve of the smaller mesh size and the greater mesh size denotes (which also may have a "+" sign in front of the mesh size) the size of particles that are incapable of passing through an ASTM standard testing sieve of the larger mesh size. For example, particles having sizes in the range of from 16 to 35 mesh (−16/+35 mesh) means that particles are included in this range which are capable of passing through an ASTM No. 16 U.S.A. standard testing sieve, but incapable of passing through an ASTM No. 35 U.S.A. standard testing sieve.

As used herein, the term "cutting structure" is meant to include the elements used to remove the formation such as teeth, inserts and cutter elements and the structure supporting those elements such as the cone, blade, etc.

Hardfacing compositions formed in accordance with the teachings of the present invention may be used on other tools in a wide variety of industries and is not limited to downhole tools for the oil and gas industry. The hardfacing compositions of the present invention may be applied to the surface of any tool utilized in a downhole application. Downhole tools may include, but are not limited to, drill bits, reamers, hole openers, stabilizers, etc. For purposes of explanation only, a layer of hardfacing formed in accordance with the teachings of the present invention are shown on rotary cone drill bits and their associated cutter cone assemblies.

An example of a downhole tool is a milled tooth roller cone drill bit shown in FIG. 1. The milled tooth roller cone drill bit 30 includes a steel body 10 having a threaded coupling ("pin") 11 at one end for connection to a conventional drill string (not shown). At the opposite end of the drill bit body 10 there is a cutting structure comprising a roller cone 12, for drilling earthen formations to form an oil well or the like ("wellbore"). Each roller cone 12 is rotatably mounted on a journal pin (not shown) extending inwardly on the bit leg 13 which extends downwardly from the bit body 10. Each bit leg 13 has a shirttail region 20. As the bit is rotated by the drill string (not shown) to which it is attached the roller cones 12 effectively roll on the bottom of the well bore being drilled. The roller cones 12 are shaped and mounted so that as they roll, teeth 14 on the cones 12 gouge, chip, crush, abrade, and/or erode the earthen formations (not shown) at the bottom of the wellbore. The teeth 14G in the row around the heel of the cone 12 are referred to as the "gage row" teeth. They engage the bottom of the hole being drilled near its perimeter or "gage". Fluid nozzles 15 direct drilling fluid ("mud") into the hole to carry away the particles of formation created by the drilling.

Such a roller cone drill bit as shown in FIG. 1 is conventional and is therefore merely one example of various arrangements that may be used in a drill bit which is made according to the invention. For example, the roller cone drill bit illustrated in FIG. 1 has three roller cones. However, one, two and four roller cone drill bits are also known in the art. Therefore, the number of such roller cones on a drill bit is not intended to be a limitation on the scope of the present disclosure. The arrangement of the teeth 14 on the cones 12 shown in FIG. 1 is just one of many possible variations. In fact, it is typical that the teeth on the three cones on a rock bit differ from each other so that different portions of the bottom of the hole are engaged by each of the three roller cones so that collectively the entire bottom of the hole is drilled. A broad variety of tooth and cone geometries are known and do not form a specific part of this invention, nor should the present disclosure be limited in scope by any such arrangement.

Figure 2:
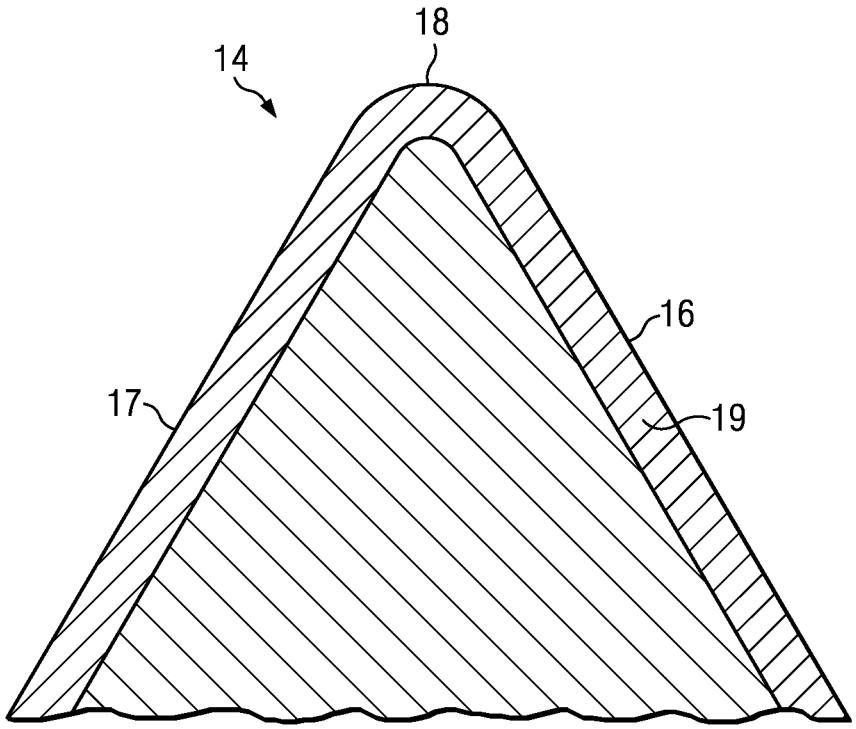
FIG. 2 illustrates a cross sectional view of a milled tooth comprising a layer of hardfacing of one or more embodiments of the present disclosure.

The example teeth on the roller cones shown in FIG. 1 are generally triangular in a cross-section taken in a radial plane of the cone. Referring to FIG. 2, such a tooth 14 has a leading flank 16 and a trailing flank 17 meeting in an elongated crest 18. The flanks and crest of the tooth 14 is covered with a hardfacing layer 19. Sometimes only the leading face of each such tooth 14 is covered with a hardfacing layer so that differential erosion between the wear-resistant steel on the trailing face of the tooth tends to keep the crest of the tooth relatively sharp for enhanced penetration of the rock being drilled. The leading flank of the tooth is the face of the tooth that leads the tooth relative to the direction of motion of the cone.

In an example embodiment, although not specifically illustrated herein, the crest of a tooth, that is, the portions facing in more or less an axial direction on the cone, may be the only portion of the teeth provided with a layer of hardfacing. This may be particularly beneficial on the so-called gage row of the bit which is often provided with hardfacing.

In an example embodiment, although not specifically illustrated herein, a hardfacing composition may be applied to one or more of the bit legs 13 to form a layer of hardfacing. The hardfacing may be applied on the shirttail region of the bit legs. Other areas of the bit leg may also be provided with a layer of hardfacing such as described in U.S. Patent Publication No. 2007/0163812 A1 (see page 1, paragraphs 5-11); U.S. Patent Publication No. 2006/0283638 A1 (see page 1, paragraphs 7-8 and page 4, paragraphs 38-45); U.S. Patent Publication No. 2008/0223619 (see page 2, paragraphs 29-38); and U.S. Patent Publication No. 2008/0202817 A1 (see page 2, paragraphs 19-21), which are each incorporated by reference.

While the present disclosure has been described with respect to a limited number of embodiments, one of ordinary skill in the art would also recognize that any exterior surface of a drill bit may be provided with a layer of hardfacing.

The inner row teeth 14 work under very high and complex stresses when crushing, gouging, and scraping the earthen formation for drilling the well. These complex stresses in combination with the heat generated by the work of the teeth on the earthen formation, especially at the crest of the teeth, tend to cause the initiation of fatigue cracks in the steel matrix of the hardfacing and subsequent loss of the hardfacing due to gross fracture and chipping. One way of enhancing the strength of the hardfacing is to increase the toughness of the iron-based matrix and improve the wear resistance of the carbide particles contained within the hardfacing.

Without wishing to be bound by theory, it is believed that the presence of eta phase and oxide particles in the matrix formed during application of the hardfacing reduces the toughness of the matrix (i.e., the matrix becomes more brittle). Eta phase (e.g., $(WFe)_6C$ and $(WCo)_6C$) and oxide particles form in the iron-based matrix material during hardfacing application. Excessive heat, which enhances element diffusion and chemical reaction kinetics, increases the eta and/or oxide content. The eta phase and oxides are brittle compounds. Thus, a matrix containing a large portion of eta phase and/or oxide particles tends to be brittle and more prone to fracture.

When a hardfacing material is applied to a surface of a drill bit, relatively high temperatures are used to melt the matrix material. Without wishing to be bound by theory, it is believed that at these relatively high temperatures, dissolution may occur between the carbide particles, especially sintered metal carbide particles, and the matrix material (e.g., iron-based binder alloy). In other words, during the application of the hardfacing material, the melted iron in the matrix material can diffuse into the carbide particles, especially the sintered metal carbide particles, and the metal binder of sintered metal carbide particles can also diffuse out of the sintered metal carbide particles into the matrix material. However, sintered metal carbide particles are typically used in hardfacing materials for imparting improved toughness properties to the hardfacing as compared to cast carbide and stoichiometric carbides (e.g., monotungsten carbide). When the hardfacing material includes sintered metal carbide particles of tungsten carbide cobalt, dissolution may be great as the cobalt metal binder of the sintered carbide particles has a lower melting temperature than the iron-based binder alloy of the matrix material. The rate of dissolution increases with increasing temperature and increasing time of exposure of the hardfacing to heat. For example, an iron-based matrix material will have greater dissolution of sintered tungsten carbide cobalt particles than a nickel-based matrix material will, because of the higher temperatures and longer heating times required to bring the iron-based matrix material into a molten state during application. However, iron-based matrix materials are typically preferred over nickel-based matrix materials in hardfacing of teeth of mill-tooth bits because iron-based materials provide improved strength. Thus, utilizing an iron-based matrix material provides unique challenges to minimize dissolution. Dissolution can significantly reduce the density of carbide particles which can lead to a reduction in wear resistance. In particular, some sintered metal carbide particles may be completely dissolved. In addition, metal binder diffusing from sintered metal carbide particles into the matrix material provides metal atoms for eta phase formation which can lead to reduced toughness.

It has been found that the dissolution of the carbide particles, especially sintered tungsten carbide particles, and formation of eta phase and oxide particles in the iron-based matrix material can be minimized by using hardfacing compositions in accordance with the teachings of the present disclosure.

Figure 3:
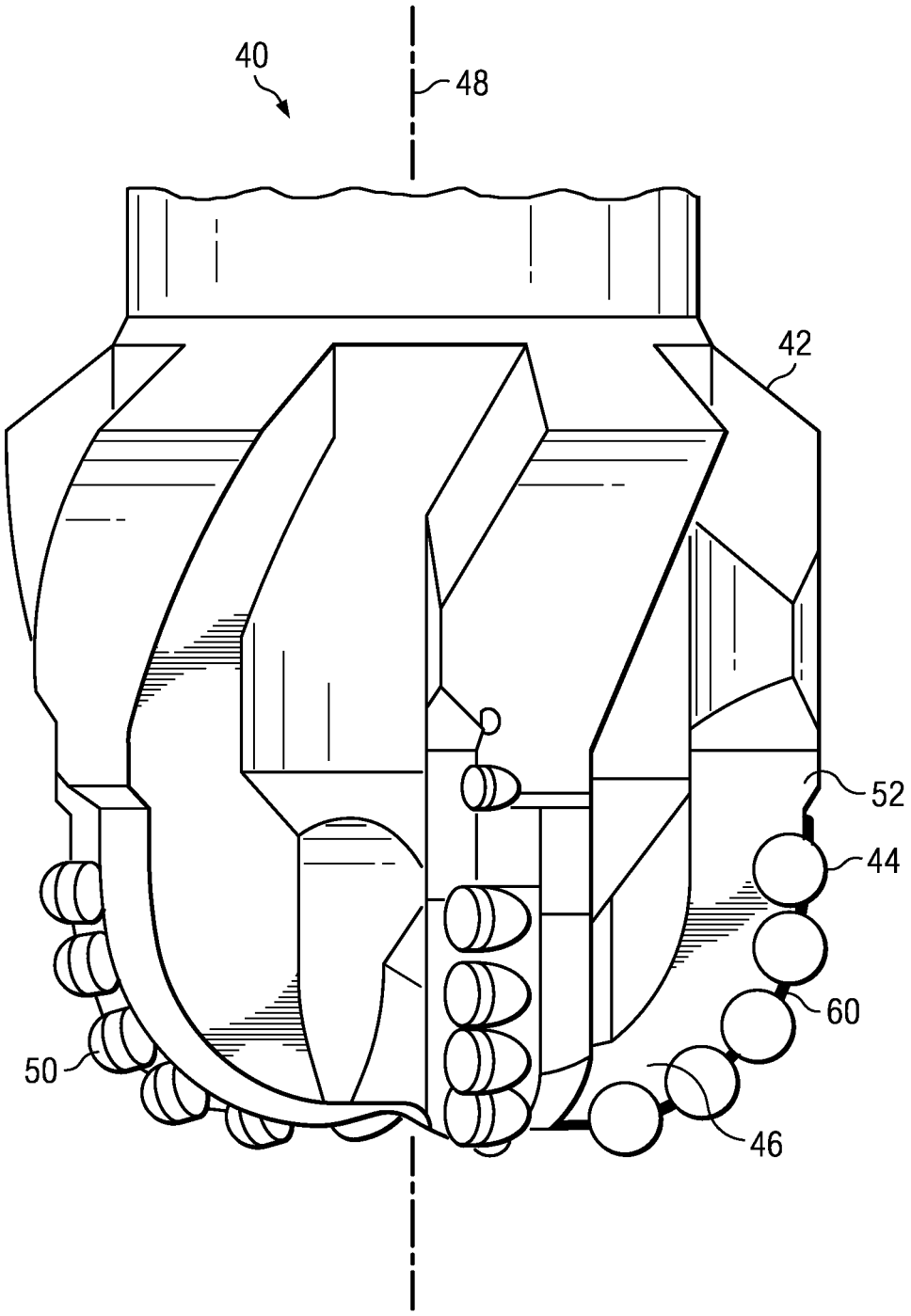
FIG. 3 illustrates a fixed cutter drill bit.

Another example of a downhole tool is a fixed cutter drill bit shown in FIG. 3. In this example, as shown in FIG. 3, a fixed cutter drill bit 40 includes a bit body 42, which includes a cutting structure comprising at least one blade and at least one polycrystalline diamond compact (PDC) cutter element 44 disposed thereon. Typically, the bit body may be formed of steel or a matrix material. The matrix material may be formed from a powdered tungsten carbide infiltrated with a binder alloy within a suitable mold form. The bit body 42 is formed with at least one blade 46, which extends generally outward away from a central longitudinal axis 48 of the drill bit 40. In this example, the bit body may include one or more layers of hardfacing 60 for abrasion and/or erosion resistance. The PDC cutter element 44 is disposed on the blade 46. The blade 46 includes at least one cutter pocket 50 which is adapted to receive the PDC cutter element 44, and the PDC cutter element 44 is usually brazed into the cutter pocket 50. The area of the blade 46 that contacts the wall of the wellbore (not shown separately) is the gage area 52. The number of blades 46 and/or PDC cutter elements 44 are related, among other factors, to the type of formation to be drilled, and can thus be varied to meet particular drilling requirements. The PDC cutter element 44 may be formed from a sintered tungsten carbide composite substrate and a polycrystalline diamond layer or table, among other materials. The polycrystalline diamond layer and the sintered tungsten carbide substrate may be bonded together using any method known in the art. The one or more layers of hardfacing may be deposited on any exterior surface of the fixed cutter drill bit. In some example embodiments, the hardfacing may be deposited on at least a portion of a blade of the fixed cutter drill bit which may include at least a portion of the cutter pocket. In other example embodiments, the hardfacing layer may be deposited on the gage area of the fixed cutter drill bit. Additional description relating to locations of a fixed cutter drill bit having hardfacing deposited thereon may be found in U.S. Patent Publication No. 2008/0083568 A1 (see page 3, paragraph 32 through page 4, paragraph 47) and U.S. Patent Publication No. 2008/0053709 A1 (see page 2 paragraph 15 through page 3, paragraph 34 and page 3, paragraph 41 through page 4, paragraph 51), which are each incorporated herein by reference in their entirety.

A hardfacing layer may be applied to the surface of the downhole tool (e.g., drill bit) by providing a tool and a hardfacing composition, applying the hardfacing composition by heating such that the iron-based binder alloy melts, and allowing the molten binder alloy to solidify. There are various methods known in the art for depositing hardfacing, for example oxyacetylene welding process (OXY), plasma transferred arc (PTA), an atomic hydrogen welding (ATW), welding via tungsten inert gas (TIG), gas tungsten arc welding (GTAW), high velocity oxy-fuel spraying (HVOF), high velocity air fuel spraying (HVAF), flame spray, and other applicable processes. Of particular concern are the high temperatures and exposure times used in the application of hardfacing compositions containing an iron-based binder alloy due to the high melting temperatures of iron-based binder alloys. Oxyacetylene processes can be especially of concern due to the excessive heating and exposure times. When the surface on which the hardfacing composition is to be applied has a complicated geometry (e.g., the cones and/or teeth of a roller cone drill bit or the cutting structure of a fixed cutter drill bit), an oxyacetylene welding process is particularly suitable. In oxyacetylene welding, the hardfacing material is typically supplied in the form of a tube or hollow rod ("a welding tube"), which is filled with granular material (a "filler") of a certain composition. The tube is usually made of steel or other iron-based metal which can act as a binder when the rod and its granular filler contents are heated. The tube thickness may be selected so that its metal forms a selected fraction of the total composition of the hardfacing material (before application to the drill bit). Alternatively, the iron-based binder alloy may be in the form of a wire ("a welding wire") and the filler materials are coated on the wire using resin binders.

Embodiments of the present disclosure relate to compositions of hardfacing materials for application to downhole tools such as drill bits. The hardfacing compositions of the present disclosure comprise a carbide phase and an iron-based binder alloy. As used herein, the term "carbide phase", is meant to include the materials which may be placed within a welding tube or which may be placed upon a welding wire, i.e., the filler. As used herein, the term "iron-based binder alloy" is meant to include the matrix material which includes materials other than those in the carbide phase.

The iron-based binder alloy may be any iron-based alloy. Suitably, the iron-based binder alloy may be an iron-containing metal alloy having a melting point that is at least 1300° C., more suitably at least 1400° C. Such iron-based binder alloys may include, but are not limited to, soft steels. As used herein, the term "soft steel" is meant to include steel materials which have a low carbon content, for example steel having a carbon content of less than 0.15% by weight, based on the total weight of the steel (i.e., mild steel). Examples of mild steel include, but are not limited to, AISI (American Iron and Steel Institute) 1010 (0.1% w carbon), AISI 1008 (0.08% w carbon), and AISI 1006 (0.06% w carbon) grades of steel.

The carbide phase ("filler") may be present in an amount of 50% to 75% by weight, based on the total weight of the hardfacing composition, in particular from 55% w to 70% w, more in particular from 60% w to 70% w, for example 67% w, on the same basis. Thus, the iron-based binder alloy may be present in an amount of from 25% to 50% by weight, based on the total weight of the hardfacing composition, in particular from 30% w to 45% w, more in particular from 30% w to 40% w, for example 33% w, on the same basis. All percentages given herein are pre-application percentages unless specified to the contrary. The proportions can be controlled, for example, by using steel tubes or wires of different thickness and diameter. For example to obtain a 70% w carbide phase and 30% w iron-based binder alloy, a 5/32 inch (4 mm) diameter tube is made with steel having a wall thickness of 0.017 inch (0.43 mm). Alternatively, a 3/16 inch (4.5 mm) diameter steel tube with a wall 0.02 inch (0.5 mm) thick will produce roughly the same weight ratio.

The carbide phase may comprise a deoxidizer. A suitable deoxidizer may include a silicomanganese composition which may be obtained from Chemalloy in Bryn Mawr, Pa. A suitable silicomanganese composition may contain 65% w to 68% w manganese, 15% w to 18% w silicon, a maximum of 2% w carbon, a maximum of 0.05% w sulfur, a maximum of 0.35% w phosphorus, and a balance comprising iron. Suitably, the deoxidizer may be present in a quantity of at most 5% w, based on the total weight of the carbide phase, for example about 3% w to about 4% w, on the same basis, may be used.

The carbide phase may also comprise a temporary resin binder. A small amount of thermoset resin is desirable for partially holding the particles in the carbide phase together so that they do not shift during application, e.g., welding. Suitably, the resin binder may be present in a quantity of at most 1% w, based on the total weight of the carbide phase, for example about 0.5% w, on the same basis may be adequate. The term, "deoxidizer", as used herein, refers generally to deoxidizer with or without the resin. Suitably, the deoxidizer/resin binder will form no more than about 5% w, preferably about 4% w, based on the total weight of the carbide phase.

I. In a certain embodiment, the hardfacing composition comprises an iron-based binder alloy and a carbide phase comprising a sintered carbide and a cast tungsten carbide. In this embodiment, the cast tungsten carbide may be in the form of crushed or spherical particles. In one or more embodiments, the cast tungsten carbide may be in the form of crushed particles. The cast tungsten carbide comprises particles having sizes in the range of from 30 to 60 mesh (−30/+60 mesh), more in particular from 40 to 60 mesh (−40/+60 mesh). In this embodiment, the cast tungsten carbide is present in a quantity of more than 20% by weight, based on the total weight of the carbide phase, in particular at least 22% w, for example in the range of from 22.5% w to 55% w, from 25% w to 40% w, or from 25% w to 35% w, on the same basis. For example, the cast tungsten carbide may be present in a quantity of 24% w, 26% w, 27% w, 28% w, 30% w, 32% w, 33% w, or 34% w, on the same basis. In this certain embodiment, it has been found that increasing both the amount and size of cast tungsten carbide particles (which are harder and/or more wear resistant than sintered carbide) while reducing the amount of sintered carbide particles in the carbide phase results in a hardfacing composition which exhibits an improvement in wear resistance without sacrificing toughness. The term, "crushed", as used herein in the present disclosure, means any particle having corners, sharp edges and angular projections commonly found in non-spherical particles.

In this certain embodiment as well as other embodiments in the present disclosure, at least a portion of the cast tungsten carbide particles may be present in the form of particles having a core (or inner region) of cast tungsten carbide and a shell (or outer region) of mono-tungsten carbide. Such cast tungsten carbide particles are described in U.S. Patent Publication No. 2007/0079905, which is incorporated by reference in its entirety (see page 1, paragraph 13 through page 3, paragraph 33). Such cast tungsten carbide particles may have a bound carbon content in the range of from 4% w to 6% w, based on the total weight of the particle, in particular from 4.5% w to 5.5% w, more in particular 4.3% w, to 4.8% w, on the same basis. The free carbon content of such cast tungsten carbide particles may be at most 0.1% w, on the same basis. Such cast tungsten carbide particles may be made using a process wherein cast tungsten carbide powder is heated in the presence of a carbon source to a temperature of 1300 to 2000° C., preferably 1400 to 1700° C.

In this certain embodiment as well as other embodiments in the present disclosure, the sintered carbide comprises a carbide and a metal binder. The carbide particles are sintered together in the presence of a metal binder. The carbide may include, but is not limited to, tungsten carbide, chromium carbide, molybdenum carbide, niobium carbide, tantalum carbide, titanium carbide, vanadium carbide, and mixtures thereof, in particular tungsten carbide. The metal binder may include, but is not limited to, Group VIII elements of the Periodic Table (CAS version of the Periodic Table found in the CRC Handbook of Chemistry and Physics, inside cover), in particular cobalt, nickel, iron, mixtures thereof, and alloys thereof. Preferably, the metal binder comprises cobalt. The sintered carbide may be in the form of crushed particles or spherical particles (i.e., pellets).

In this certain embodiment, the sintered carbide may be present in a quantity in the range of 10% w to 70% w, based on the total weight of the carbide phase, in particular from 30% w to 65% w, on the same basis. For example, the sintered carbide may be present in a total quantity of 47.5% w, 52.5% w, 57.5% w, 60% w, on the same basis. The sintered carbide may comprise particles having sizes incapable of passing through 50 mesh or smaller mesh sizes, in particular in the range of from 16 to 50 mesh (−16/+50 mesh), more in particular from 16 to 40 mesh (−16/+40 mesh).

In one or more embodiments, the carbide phase may include a first quantity of sintered carbide having particle sizes in the range of from 16 to 25 mesh (−16/+25 mesh), in particular from 16 to 20 mesh (−16/+20 mesh), and a second quantity of sintered carbide comprising particles having sizes that may be in the range of from 25 to 50 mesh (−25/+50 mesh), in particular from 30 to 40 mesh (−30/+40 mesh). In this embodiment, the first quantity of sintered carbide may be present in an amount of at least 10% by weight, based on the total weight of the carbide phase, for example at least 20% w or at least 25% w, on the same basis. In this embodiment, the first quantity of sintered carbide may be present in an amount in the range of from 10 to 65% by weight, based on the total weight of the carbide phase, for example from 20 to 60% w, from 25 to 50% w, or from 30 to 40% w, on the same basis. For example, the first quantity of sintered carbide may be present in a quantity of 15% w, 17.5% w, 22.5% w, 27.5% w, 32.5% w, 35% w, 37.5% w, 42.5% w, or 47.5% w, on the same basis. In this embodiment, the second quantity of sintered carbide may be present in an amount of at least 10% by weight, based on the total weight of the carbide phase, for example at least 15% w or at least 20% w, on the same basis. In this embodiment, the second quantity of sintered carbide may be present in an amount in the range of from 10 to 50% by weight, based on the total weight of the carbide phase, for example from 15 to 40% w or from 20 to 30% w, on the same basis. For example, the second quantity of sintered carbide may be present in a quantity of 15% w, 17.5% w, 22.5% w, 24% w, 25% w, 27.5% w, 32.5% w, or 37.5% w, on the same basis. Suitably, the first quantity of sintered carbide may be present in an amount that is greater than the second quantity of sintered carbide, in particular the first quantity may be present in a greater amount than the second quantity by at least 5% w, based on the weight percentages of the first quantity and second quantity of sintered carbide calculated based on the total weight of the carbide phase. The first quantity may be present in a greater amount than the second quantity by at most 15% w, based on the weight percentages of the first quantity and second quantity of sintered carbide calculated based on the total weight of the carbide phase. For example, a carbide phase containing 35% w (based on total weight of the carbide phase) of a first quantity of sintered carbide and 24% w (based on the total weight of the carbide phase) of a second quantity of sintered carbide has a first quantity of sintered carbide that is 11% w greater than the second quantity of sintered carbide. In one or more embodiments, the first quantity and second quantity of sintered carbide may be present in a total quantity of at most 65% w, based on the total weight of the carbide phase, in particular at most 60% w, on the same basis. In one or more embodiments, the amount of cast carbide may be equal to or greater than the amount of the second quantity of sintered carbide, in particular the amount of cast carbide may be present in a greater amount than the second quantity of sintered carbide by at least 1% w, for example at least 3% w, based on the weight percentages of the cast carbide and the second quantity of sintered carbide calculated based on the total weight of the carbide phase.

In one or more embodiments, at least a portion of the sintered carbide may be in the form of super dense sintered carbide, as generally described hereinafter. Suitably, the first and/or second quantities of sintered carbide in these certain embodiments may be in the form of super dense sintered carbide.

In one or more embodiments, the carbide phase may further comprise an additional carbide. The additional carbide may be monotungsten carbide. The additional carbide may be present in a quantity in the range of 10% w to 50% w, based on the total weight of the carbide phase, in particular from 15% w to 40% w, on the same basis. For example, the additional carbide may be present in a quantity of 10% w, 15% w, 20% w, 25% w, on the same basis. The additional carbide may comprise particles having sizes incapable of passing through 50 mesh or smaller mesh sizes, in particular in the range of from 16 to 50 mesh (−16/+50 mesh), more in particular from 16 to 40 mesh (−16/+40 mesh).

In one or more embodiments, the carbide phase may comprise a filler carbide. Such filler carbide is suitably used to strengthen the binder alloy. The filler carbide may be any other carbide, preferably mono-tungsten carbide, in particular carburized tungsten carbide. The filler carbide may be present in a quantity of from 5% w to 15% w, based on the total weight of the carbide phase, in particular from 8% w to 12% w, on the same basis. The filler carbide may comprise particles having sizes in the range of from 200 to 625 mesh (−200/+625 mesh), in particular from 300 to 500 mesh (−300/+500 mesh).

II. In another certain embodiment, the hardfacing composition comprises a carbide phase comprising a super dense sintered carbide and an additional carbide. In this embodiment, the super dense sintered carbide comprises large sized particles having sizes in the range of from 16 to 40 mesh (−16/+40 mesh), in particular from 16 to 35 mesh (−16/+35 mesh). Preferably, the super dense sintered carbide may contain about 94% w tungsten carbide and about 6% w cobalt, based on the total weight of the super dense sintered carbide. The super dense sintered carbide may be in the form of spherical particles. The term "spherical", as used herein and throughout the present disclosure, means any particle having a generally spherical shape and may not be true spheres, but lack the corners, sharp edges, and angular projections commonly found in crushed and other non-spherical particles. An advantage from utilizing large super dense sintered carbide particles in a hardfacing composition is that an improvement in wear resistance while maintaining toughness can be obtained. Without wishing to be bound by theory, it is believed that super dense particles tend to be more resistant to dissolution and eta phase and/or oxide formation because of less surface contact with the matrix metal compared to a hardfacing using same volume percentage but smaller sintered carbide particles. In addition, larger super dense sintered carbide particles have better bonding with the matrix than smaller particles. Therefore, using large super dense sintered carbide particles can improve hardfacing performance.

The super dense sintered carbide comprises a carbide and a metal binder. The carbide particles are sintered together in the presence of the metal binder. The carbide may include, but is not limited to, tungsten carbide, chromium carbide, molybdenum carbide, niobium carbide, tantalum carbide, titanium carbide, vanadium carbide, and mixtures thereof, in particular tungsten carbide. The metal binder may include, but is not limited to, Group VIII elements of the Periodic Table (CAS version of the Periodic Table found in the CRC Handbook of Chemistry and Physics, inside cover), in particular cobalt, nickel, iron, mixtures thereof, and alloys thereof. Preferably, the metal binder comprises cobalt. The term "super dense sintered carbide", as used herein, includes the class of sintered particles as disclosed in U.S. Patent Publication No. 2003/0000339, the disclosure of which is incorporated herein by reference (page 2, paragraph 19 through page 3, paragraph 47). Such super dense sintered carbide particles are typically of substantially spheroidal shape (i.e., pellets) and have a predominantly closed porosity or are free of pores. The process for producing such particles starts from a powder material with a partially porous internal structure, which is introduced into a furnace and sintered at a temperature at which the material of the metal binder adopts a pasty state while applying pressure to reduce the pore content of the starting material to obtain a final density.

The large sized super dense sintered carbide may be present in an amount of at least 10% by weight, based on the total weight of the carbide phase, in particular at least 20% w, more in particular at least 25% w on the same basis. The large sized super dense sintered carbide may be present in an amount in the range of from 10 to 70% by weight, based on the total weight of the carbide phase, for example from 30 to 65% w or from 35 to 60% w, on the same basis. For example, the large sized super dense sintered carbide may be present in a quantity of 22.5% w, 27.5% w, 32.5% w, 35% w, 37.5% w, 42.5% w, 47.5% w, 52.5% w, 55% w, 57.5% w, or 62.5% w, on the same basis.

The one or more additional carbide materials may be any other metal carbide beside super dense sintered carbide. Suitably, the one or more additional carbides may be selected from non-super dense sintered metal carbide, cast tungsten carbide, mono-tungsten carbide, and combinations thereof. Suitably, the monotungsten carbide may comprise macrocrystalline tungsten carbide and/or carburized tungsten carbide. The one or more additional carbides may be in the form of crushed particles and/or spherical particles which includes crushed and spherical cast tungsten carbide particles; crushed and spherical mono-tungsten carbide particles; and crushed and spherical non-super dense sintered metal carbide particles (e.g., tungsten carbide). Suitably, the cast tungsten carbide may comprise a core of cast tungsten carbide with a shell of mono-tungsten carbide, as described in more detail hereinbefore.

In one or more embodiments, the one or more additional carbide materials may comprise a first additional carbide and a second additional carbide. The first additional carbide may comprise particles having sizes incapable of passing through 400 mesh, in particular in the range of from 20 to 80 mesh (−20/+80 mesh), more in particular 30 to 60 mesh (−30/+60 mesh) and may include those carbides described in the previous paragraph, preferably cast tungsten carbide, more preferably crushed cast tungsten carbide. Suitably, the first additional carbide may be cast tungsten carbide having particles with sizes in the range of from 40 to 60 mesh (−40/+60 mesh). The second additional carbide may comprise very small particles having sizes capable of passing through mesh sizes of 300 mesh or greater, in particular 300 to 500 mesh, and may be selected from non-super dense sintered metal carbide, cast tungsten carbide and monotungsten carbide, preferably monotungsten carbide. Preferably, the monotungsten carbide may be carburized tungsten carbide. The first additional carbide may be present in an amount in the range of from 10 to 70% by weight, based on the total weight of the carbide phase, in particular from 20% w to 50% w, on the same basis. The second additional carbide may be present in an amount in the range of from 5 to 15% by weight, based on the total weight of the carbide phase, in particular from 8% w to 12% w, on the same basis.

In one or more embodiments, the carbide phase may include a first quantity of super dense sintered carbide, as discussed hereinbefore, having particle sizes in the range of from 16 to 25 mesh (−16/+25 mesh), in particular from 16 to 20 mesh (−16/+20 mesh), and/or a second quantity of super dense sintered carbide comprising particles having sizes that are in the range of from 25 to 40 mesh (−25/+40 mesh), in particular from 30 to 40 mesh (−30/+40 mesh). In this embodiment, the first quantity of super dense sintered carbide may be present in an amount of at least 10% by weight, based on the total weight of the carbide phase, for example at least 20% w or at least 25% w, on the same basis. In this embodiment, the first quantity of super dense sintered carbide may be present in an amount in the range of from 10 to 70% by weight, based on the total weight of the carbide phase, for example from 20 to 50% w, from 25 to 50% w, or from 30 to 40% w, on the same basis. For example, the first quantity of super dense sintered carbide may be present in a quantity of 15% w, 17.5% w, 22.5% w, 27.5% w, 32.5% w, 35% w, 37.5% w, 42.5% w, 45% w, or 47.5% w, on the same basis. In this embodiment, the second quantity of super dense sintered carbide may be present in an amount of at least 10% by weight, based on the total weight of the carbide phase, for example at least 15% w or at least 20% w, on the same basis. In this embodiment, the second quantity of super dense sintered carbide may be present in an amount in the range of from 10 to 50% by weight, based on the total weight of the carbide phase, for example from 15 to 40% w or from 20 to 30% w, on the same basis. For example, the second quantity of super dense sintered carbide may be present in an quantity of 15% w, 17.5% w, 22.5% w, 24% w, 25% w, 27.5% w, 32.5% w, or 37.5% w, on the same basis. Suitably, the first quantity of super dense sintered carbide may be present in an amount that is greater than the second quantity of super dense sintered carbide, in particular the first quantity may be present in a greater amount than the second quantity by at least 5% w, based on the weight percentages of the first quantity and second quantity of super dense sintered carbide which are calculated based on the total weight of the carbide phase. The first quantity may be present in a greater amount than the second quantity by at most 15% w, based on the weight percentages of the first quantity and second quantity of sintered carbide calculated based on the total weight of the carbide phase. For example, a carbide phase containing 35% w (based on total weight of the carbide phase) of a first quantity of super dense sintered carbide and 24% w (based on the total weight of the carbide phase) of a second quantity of super dense sintered carbide has a first quantity that is 11% w greater than the second quantity.

In one or more embodiments, the carbide phase may include a first quantity of super dense sintered carbide and/or a second quantity of super dense sintered carbide, as discussed above, and additionally a cast tungsten carbide, preferably crushed, comprising particles having sizes in the range of from 40 to 60 mesh (−40/+60 mesh) and optionally a monotungsten carbide comprising particles having sizes capable of passing through mesh sizes of 300 mesh or greater, in particular from 300 to 500 mesh (−300/+500 mesh). The cast tungsten carbide may be present in an amount in the range of from 5 to 50% by weight, based on the total weight of the carbide phase, for example from 20% w to 50% w or from 22% w to 40% w, on the same basis. The monotungsten carbide may be present in an amount in the range of from 5 to 15% by weight, based on the total weight of the carbide phase, in particular from 8% w to 12% w, on the same basis. Suitably, the amount of cast carbide may be equal to or greater than the amount of the second quantity of super dense sintered carbide, if present, in particular the amount of cast carbide may be present in a greater amount than the second quantity of super dense sintered carbide by at least 1% w, for example at least 3% w, based on the weight percentages of the cast carbide and the second quantity of super dense sintered carbide calculated based on the total weight of the carbide phase. For example, a carbide phase containing 27% w (based on the total weight of the carbide phase) of a cast carbide and 24% w (based on the total weight of the carbide phase) of a second quantity of super dense sintered carbide has an amount of cast carbide that is 3% w greater than the second quantity of super dense sintered carbide.

In one or more embodiments, the carbide phase may include a super dense sintered carbide comprising particles having sizes that are in the range of from 30 to 40 mesh (−30/+40 mesh). In this embodiment, the quantity of super dense sintered carbide may be present in an amount of at least 25% by weight, based on the total weight of the carbide phase, for example at least 35% w or at least 50% w, on the same basis. In this embodiment, the quantity of super dense sintered carbide may be present in an amount in the range of from 25 to 80% by weight, based on the total weight of the carbide phase, for example from 35 to 75% w or from 55 to 70% w, on the same basis. For example, the quantity of super dense sintered carbide may be present in a quantity of 40% w, 45% w, 55% w, 57.5% w, 62.5% w, 65% w, or 67.5% w, on the same basis. In this embodiment, the carbide phase may additionally include a cast tungsten carbide, preferably crushed, comprising particles having sizes in the range of from 80 to 325 mesh (−80/+325 mesh), in particular from 100 to 200 mesh (−100/+200 mesh) and optionally a monotungsten carbide comprising particles having sizes capable of passing through 300 mesh or greater mesh sizes, in particular from 300 to 500 mesh (−300/+500 mesh). The cast tungsten carbide, preferably crushed, may be present in an amount in the range of from 10 to 30% by weight, based on the total weight of the carbide phase, in particular from 15% w to 25% w, on the same basis. The monotungsten carbide may be present in an amount in the range of from 5 to 15% by weight, based on the total weight of the carbide phase, in particular from 8% w to 12% w, on the same basis.

In one or more embodiments, the carbide phase may include a first quantity of super dense sintered carbide, as discussed above, and a further quantity of small sized super dense sintered carbide comprising particles having sizes in the range of from 80 to 400 mesh (−80/+400 mesh), in particular 80 to 200 mesh (−80/+200 mesh). Optionally, the carbide phase may also contain a second quantity of super dense sintered carbide as discussed hereinbefore. In this embodiment, the further quantity of small sized super dense sintered carbide may be present in an amount in the range of from 5 to 50% by weight, based on the total weight of the carbide phase, in particular from 10 to 25% w, on the same basis.

In other embodiments, the carbide phase may be substantially free of the further quantity of small sized super dense particles discussed above. The term, "substantially free", is understood to mean that the hardfacing composition contains at most 3% w, preferably at most 1% w, more preferably no quantity of small sized super dense particles, based on the total weight of the carbide phase.

In these and other embodiments of the present disclosure, it is understood that the particle size distribution within the mesh ranges disclosed may be mono- or multi-modal.

After application of the hardfacing composition, the thickness of the hardfacing layer may be any thickness, suitably in the range of from about 0.06 inch (1.5 mm) to less than about 0.18 inch (4.6 mm). The carbide content in the applied hardfacing layer can be determined by metallographic examination of a cross section through the hardfacing. The areas of the carbide and binder phases can be determined. From this, the volume percentages of binder and carbide can be determined, and in turn the weight percentages for the applied hardfacing.

The following illustrates the improved properties of one or more embodiments of the present disclosure. "Composition A" and "Composition B" hardfacing compositions were prepared according to one or more embodiments of the present disclosure and demonstrate improved performance compared to comparative "Composition C", similar to U.S. Pat. No. 6,659,206 issued to Liang et al. "Composition D" hardfacing composition was prepared according to one or more embodiments of the present disclosure and demonstrates improved performance compared to comparative "Composition E". The compositions of the carbide phase of Composition A and B according to one or more embodiments of the present disclosure and comparative Composition C are outlined in Table 1 below. The composition of the carbide phase of Composition D according to one or more embodiments of the present disclosure and comparative Composition E are outlined in Table 2 below.

TABLE 1

| Carbide Phase Composition | | | | | | | |
|---|---|---|---|---|---|---|---|
| Composition | Crushed Cast Tungsten Carbide (−40/+60 mesh) [% w]** | Crushed Cast Tungsten Carbide (−40/+80 mesh) [% w]** | Sintered Tungsten Carbide Cobalt Pellets*** (−16/+20 mesh) [% w]** | Sintered Tungsten Carbide Cobalt Pellets*** (−30/+40 mesh) [% w]** | Carburized Tungsten Carbide (−400 mesh) [% w]** | Deoxidizer and resin binder [% w]** | Quantity of Carbide Phase (% w)* |
| A | 27 | — | 35 | 24 | 10 | 4 | 67 |
| B | 36 | | 29 | 21 | 10 | 4 | 67 |
| C | — | 18 | 40 | 28 | 10 | 4 | 67 |

*weight percent of the carbide phase is based on the total weight of the hardfacing composition (e.g., welding rod) pre-application: balance is iron-based binder alloy
**weight percent based on the total weight of the carbide phase pre-application
***the sintered tungsten carbide cobalt was non-super dense sintered tungsten carbide cobalt

TABLE 2

| Carbide Phase Composition | | | | | |
|---|---|---|---|---|---|
| Composition | Crushed Cast Tungsten Carbide (−100/+200 mesh) [% w]** | Sintered Tungsten Carbide Cobalt Pellets (−30/+40 mesh) [% w]** | Carburized Tungsten Carbide (−400 mesh) [% w]** | Deoxidizer and resin binder [% w]** | Quantity of Carbide Phase (% w)* |
| D | 18 | 68⁺ | 10 | 4 | 67 |
| E | 18 | 68*** | 10 | 4 | 67 |

*weight percent of the carbide phase is based on the total weight of the hardfacing composition (e.g., welding rod) pre-application: balance is binder alloy
**weight percent based on the total weight of the carbide phase pre-application
***the sintered tungsten carbide cobalt was non-super dense sintered tungsten carbide cobalt
⁺denotes super dense sintered tungsten carbide cobalt Coupon samples were hardfaced with Compositions A, B and C using a welding rod comprising the carbide phase, as described in Table 1, and a mild steel AISI 1008 tube. The hardfacing composition was applied using an oxyacetylene welding process. The samples were then subjected to the high stress wear test according to the ASTM B611 protocols, which measures the wear resistance and toughness. This test was run again on fresh coupon samples of Compositions A, B and C. Compositions A and B showed an improvement in toughness and wear resistance over comparative Composition C. In particular, the sample of Composition A only experienced an average wear volume loss of 0.3490 cc/1000 rev and the sample of Composition B only experienced an average wear volume loss of 0.3806 cc/1000 rev while the sample of Composition C experienced a wear volume loss of 0.3909 cc/1000 rev. This shows an improvement in wear volume loss.

Additionally, teeth of a milled tooth drill bit hardfaced with Composition A showed significantly improved properties after testing in the field when compared to teeth of the drill bit hardfaced with comparative Composition C. In particular, material pair comparison of a milled-tooth drill bit with teeth hardfaced with Composition A and comparative Composition C on the same cone was tested in an earthen formation. Upon completion of the field test, the drill bit was analyzed. Teeth having lost more than 30% of the hardfacing on the crest were deemed to have failed. There was significantly less failure of the hardfacing on the teeth hardfaced with Composition A than those hardfaced with Comparative Composition C. In particular, only 15% of the teeth hardfaced with Composition A failed while 39% of the teeth hardfaced with Comparative Composition C failed. While the lab wear test data indicated an improvement in properties, the field test data showed a significant improvement in actual performance. This demonstrates the improvement in properties of the hardfacing when the amount and size of cast tungsten carbide particles are increased.

Figure 4:
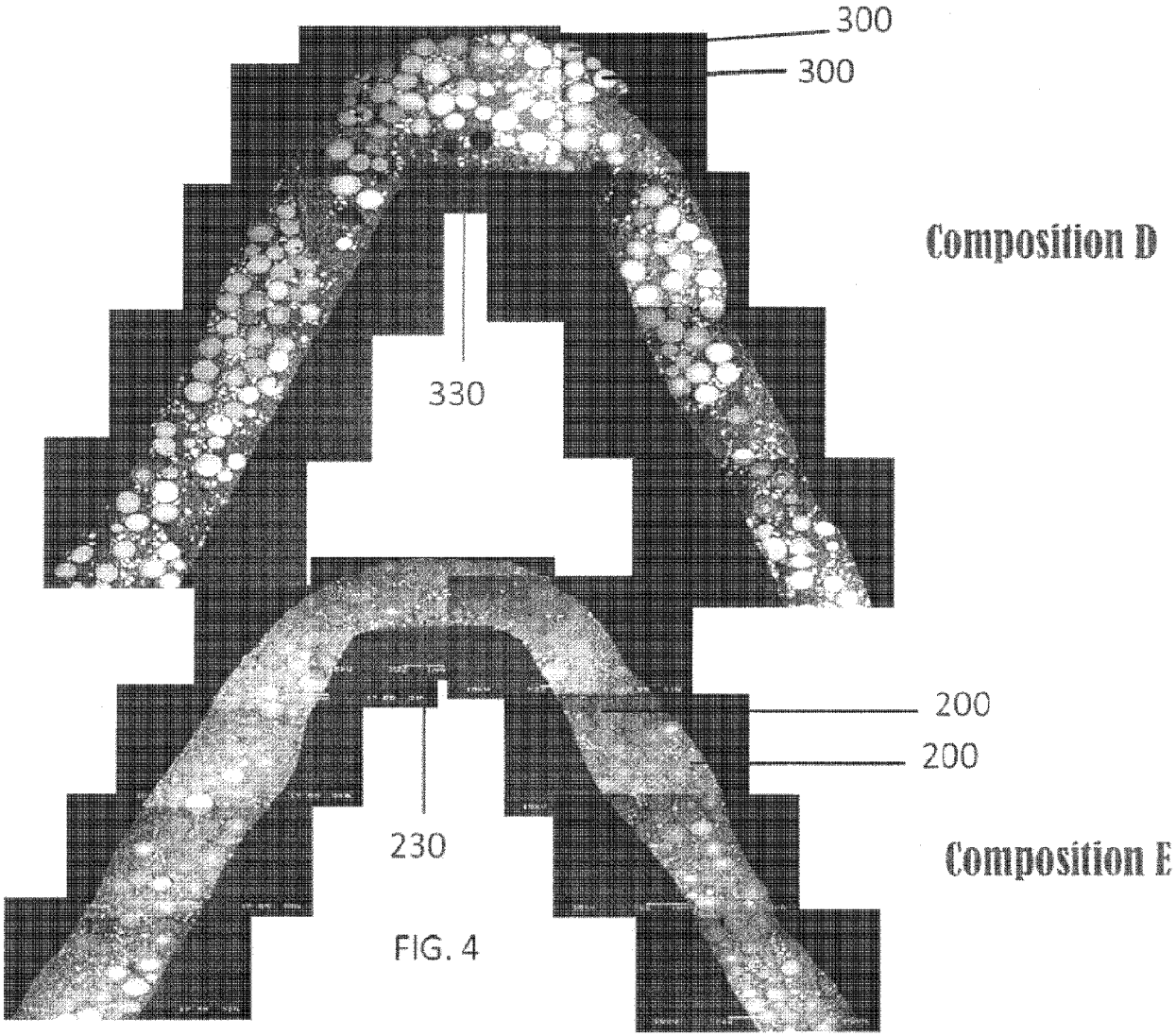
FIG. 4 shows scanning electron microscope images of several hardfacing compositions.

In another example, coupon samples were hardfaced with Compositions D and E using a welding rod comprising a carbide phase, as described in Table 2, and a mild steel AISI 1008 tube. The hardfacing composition was applied using an oxyacetylene welding process. The coupons were then subjected to the high stress test according to the ASTM B611 protocols, which measures the wear resistance and toughness. This test was run again on fresh coupon samples of Compositions D and E. Composition D showed an improvement in high stress toughness and wear resistance over comparative Composition E. In particular, the coupon samples with hardfacing Composition D only experienced an average wear volume loss of 0.3565 cc/1000 rev while coupons with comparative hardfacing Composition E experienced an average wear volume loss of 0.4234 cc/1000 rev. This is shows an improvement in wear volume loss. FIG. 4 shows scanning electron microscope (SEM) pictures of a layer of hardfacing using Composition D (330) and a layer of hardfacing using comparative hardfacing Composition E (230) applied to teeth of a drill bit. As can be seen in the pictures, the non-super dense sintered tungsten carbide particles (200) in the layer of hardfacing using comparative Composition E have less contrast compared to the matrix than the super dense sintered tungsten carbide particles (300) in the layer of hardfacing using Composition D. This indicates that the hardfacing with Composition D, which contains super dense sintered carbide pellets, has less dissolution as compared to Composition E.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A hardfacing composition comprising:

an iron-based binder alloy; and a carbide phase comprising a sintered carbide and a cast tungsten carbide, wherein the cast carbide is present in a quantity of at least 22% and no greater than 40% by weight, based on the total weight of the carbide phase, wherein the cast carbide comprises particles having sizes in the range of from 30 to 60 mesh, and wherein the sintered carbide comprises particles having sizes in the range of from 16 to 50 mesh, and wherein only a portion of the sintered carbide particles comprise a super dense sintered carbide having a predominantly closed porosity or are free of pores, and wherein a first quantity of the super dense sintered carbide particles have sizes in the range of from 16 to 25 mesh (−16/+25 mesh) and a second quantity of the super dense sintered carbide particles have sizes in the range of from 25 to 50 mesh (−25/+50 mesh).

2. The hardfacing composition of claim 1, wherein the cast tungsten carbide comprises crushed cast tungsten carbide.

3. The hardfacing composition of claim 1, wherein the quantity of cast carbide is in the range of from 22.5% to 40% by weight, based on the total weight of the carbide phase.

4. The hardfacing composition of claim 1, wherein the particles of cast carbide have sizes in the range of from 40 to 60 mesh.

5. The hardfacing composition of claim 1, wherein the cast tungsten carbide has a core of cast tungsten carbide and a shell of monotungsten carbide.

6. The hardfacing composition of claim 5, wherein said cast carbide comprises tungsten carbide particles having a bound carbon content in the range from 4% by weight to 6% by weight based on a total weight of the particles.

7. The hardfacing composition of claim 1, wherein the quantity of sintered carbide is in the range of from 10% to 70% by weight, based on the total weight of the carbide phase.

8. The hardfacing composition of claim 1, wherein the quantity of sintered carbide is in the range of from 30% to 65% by weight, based on the total weight of the carbide phase, and has particles with sizes in the range of from 16 to 40 mesh.

9. The hardfacing composition of claim 1, wherein the carbide phase further comprises a filler carbide in a quantity of from 5% to 15% by weight, based on the total weight of the carbide phase, and the filler carbide particles have sizes in the range of from 200 to 625 mesh.

10. The hardfacing composition of claim 1, wherein the amount of cast carbide is at least 1% w greater than the second quantity of sintered carbide, based on the weight percentages calculated based on the total weight of the carbide phase.

11. The hardfacing composition of claim 1, wherein the first quantity and second quantity of sintered carbide is super dense sintered carbide having a predominantly closed porosity or is free of pores.

12. The hardfacing composition of claim 11, wherein the first quantity of sintered carbide has particles with sizes in the range of from 16 to 20 mesh (−16/+20 mesh) and a second quantity of sintered carbide has particles with sizes in the range of from 30 to 40 mesh (−30/+40 mesh).

13. The hardfacing composition of claim 1, wherein the carbide phase is present in an amount of from 50% to 75% by weight, based on the total weight of the hardfacing composition.

14. The hardfacing composition of claim 1, wherein the binder alloy is present in an amount of from 25% to 50% by weight, based on the total weight of the hardfacing composition.

15. The hardfacing composition of claim 1, wherein the sintered carbide is spherical and comprises tungsten carbide and cobalt.

16. The hardfacing composition of claim 1, wherein the cast carbide is present in a quantity of 25% to 40% by weight.

17. The hardfacing composition of claim 1, wherein the cast carbide is present in a quantity of 25% to 35% by weight.

18. The hardfacing composition of claim 1, wherein the cast carbide is present in a quantity of 24% to 34% by weight.

19. A hardfacing composition comprising:

an iron-based binder alloy; and a carbide phase comprising a super dense sintered carbide and one or more additional carbides, wherein the super dense sintered carbide comprises particles having sizes in the range of from 16 to 40 mesh, wherein the carbide phase comprises a first quantity of super dense sintered carbide having particles with sizes in the range of from 16 to 25 mesh, said first quantity of super dense sintered carbide being in the range of 10% w to 70% w of the total weight of the carbide phase, and a second quantity of super dense sintered carbide having a particles with sizes of at least 25 mesh.

20. The hardfacing composition of claim 19, wherein the second quantity of super dense sintered carbide has particles with sizes in the range of from 25 to 75 mesh.

21. The hardfacing composition of claim 20, wherein the first quantity is greater than the second quantity by no greater than 15%.

22. A hardfacing composition comprising:

an iron-based binder alloy; and a carbide phase comprising a sintered carbide phase including a super dense sintered carbide and wherein the carbide phase comprises one or more additional carbides, wherein the sintered carbide phase comprises a first quantity of the sintered carbide particles have sizes in the range of from 16 to 25 mesh (−16/+25 mesh) and a second quantity of the sintered carbide particles have sizes in the range of from 25 to 50 mesh (−25/+50 mesh), wherein the first quantity of sintered carbide is present in an amount of at least 10% w, wherein the first quantity larger than the second quantity, and wherein the super dense sintered carbide is present in a quantity of 22.5% w to 47.5% w based on the total weight of the carbide phase.

* * * * *